US010479466B2

(12) United States Patent
Yepez

(10) Patent No.: US 10,479,466 B2
(45) Date of Patent: Nov. 19, 2019

(54) PADDLING APPARATUS

(71) Applicant: David Yepez, Miami Beach, FL (US)

(72) Inventor: David Yepez, Miami Beach, FL (US)

( * ) Notice: Subject to any disclaimer, the term of this patent is extended or adjusted under 35 U.S.C. 154(b) by 0 days.

(21) Appl. No.: 15/916,958

(22) Filed: Mar. 9, 2018

(65) Prior Publication Data

US 2019/0276126 A1 Sep. 12, 2019

(51) Int. Cl.

| | |
|---|---|
| ***B63H 16/04*** | (2006.01) |
| ***B63B 35/85*** | (2006.01) |
| ***E02B 15/10*** | (2006.01) |

(52) U.S. Cl.

CPC ..... *B63H 16/04* (2013.01); *E02B 15/10* (2013.01); *A63B 2225/60* (2013.01); *B63B 35/85* (2013.01); *B63H 2016/046* (2013.01)

(58) Field of Classification Search

CPC ... B63H 16/04; B63H 2016/046; E02B 15/10; A63B 2225/60; B63B 35/85

See application file for complete search history.

(56) References Cited

U.S. PATENT DOCUMENTS

| | | | | |
|---|---|---|---|---|
| 5,860,728 | A * | 1/1999 | Maglica | B62J 6/00 362/191 |
| 6,986,318 | B2 * | 1/2006 | Sawyer | B63H 9/06 114/102.1 |
| 8,602,662 | B1 * | 12/2013 | Mans | F16M 11/041 248/160 |
| 8,992,277 | B2 * | 3/2015 | Macias | B63B 35/7933 441/74 |
| 9,033,753 | B2 * | 5/2015 | Siverts | B63B 35/7959 440/101 |
| 9,884,236 | B2 * | 2/2018 | Gurney | B63H 16/04 |
| 2007/0160364 | A1 * | 7/2007 | Peika | F16M 11/14 396/428 |
| 2011/0027101 | A1 * | 2/2011 | Hartman | B63H 16/04 416/70 R |
| 2014/0360893 | A1 * | 12/2014 | Whitten | A45C 11/00 206/45.2 |

* cited by examiner

*Primary Examiner* — Anthony D Wiest

(57) ABSTRACT

A paddling apparatus that includes a paddle having a blade on at least one end of a paddle shaft, an attachment removably attachable to the paddle shaft, and an accessory connecting element on a first side of the attachment for removably connecting at least one accessory to the attachment. The accessory includes a training aid that has a first base rotatably attached with the accessory connecting element and an elongated element pivotally attached to the base.

16 Claims, 19 Drawing Sheets

PADDLING APPARATUS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field of water sports equipment, and more specifically to the field of attachments to a watercraft paddle.

BACKGROUND

Watercraft paddles are well known. Watercraft paddles are used in activities such as: kayaks, canoes, stand-up paddleboards, small watercraft, etc. Whether for recreation, strength training, or safety, one of the drawbacks of operating a paddle is that the paddler or user requires both hands to operate the paddle. In order to use a device while on a paddle-driven watercraft, the paddler has to stop paddling and secure their paddle beforehand, which may become tiring and cumbersome as the paddler loses all momentum when they stop paddling. Additionally, the paddler risks damaging or losing any item they bring on their paddle-driven watercraft due to the instability of many of those watercrafts. Consequently, the user is greatly restricted on the items they can carry or operate while operating a paddle-driven watercraft.

Stand-up paddleboarding is a popular recreational and sporting activity. When operating a stand-up paddleboard (Hereinafter, "SUP"), the user stands and balances on the SUP. The user then grasps a paddle with both hands and propels their SUP through the water while standing. The paddle has a blade on one end and a handle on the other end, as opposed to other paddles that have blades on both ends. In order to improve the speed of a paddleboard user, whether for races, physical training, or for the user's own enjoyment, the user must develop an efficient paddle stroke, as well as their strength and balance. Currently, there is no convenient and simple device to train the paddler to develop their balance, as well as their stroke efficiency and strength.

Lastly, the oceans and waterways where people operate their watercraft are becoming increasingly polluted. Many groups are dedicated to cleaning up our waterways and meet on paddle-driven watercraft to accomplish this goal. These groups prefer paddle-driven watercraft because they cause little to no additional damage to the environment, as opposed to the pollution caused by marine engines. However, there is no way to efficiently operate a paddle while being able to operate a device to clean debris out of the water. Thus, the environmental impact of these groups is lessened without such a device.

As a result, there exists a need for improvements over the prior art and more particularly for a more efficient way of attaching devices to a watercraft paddle for recreational or training purposes.

SUMMARY

A paddling apparatus is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a paddling apparatus is disclosed. In one embodiment, the paddling apparatus includes a paddle having a blade on at least one end of a paddle shaft, an attachment removably attachable to the paddle shaft, and an accessory connecting element on a first side of the attachment for removably connecting at least one accessory to the attachment. The accessory includes a training aid that has a first base rotatably attached with the accessory connecting element and an elongated element pivotally attached to the base.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
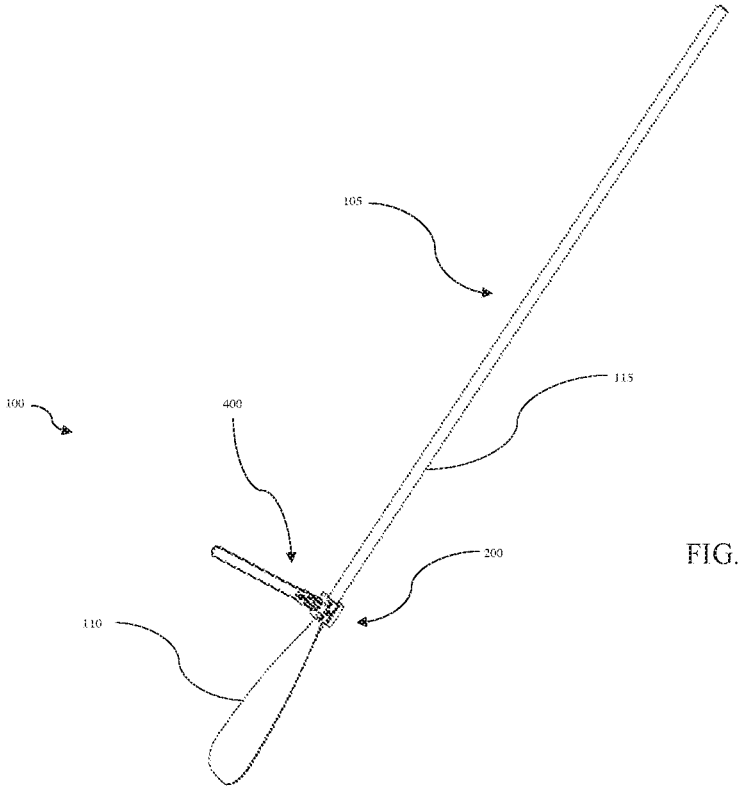
FIG. 1 is a front perspective view of the paddling apparatus in a training configuration, according to an example of the embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a paddling apparatus that allows the user to easily attach devices to a paddle, so that the user can efficiently and securely use other devices while operating a paddle. The disclosed embodiments accomplish this result by disclosing an attachment that quickly and securely attaches to a paddle, which allows accessories to be attached to the attachment. Furthermore, the disclosed embodiments provide an efficient and effective means to improve the technique, strength and balance of the person operating a paddleboard. The disclosed embodiments accomplish this result by disclosing devices to increase weight resistance and enable the user to determine the maximum stroke point, which is the most efficient point for a user to end their paddle stroke and begin a new stroke. Additionally, the disclosed embodiments provide an efficient and effective means to allow a user to help clean our waterways while operating a paddle. The disclosed embodiments accomplish the result by disclosing a net that can be attached to the paddle by an efficient and secure attachment.

Figure 2:
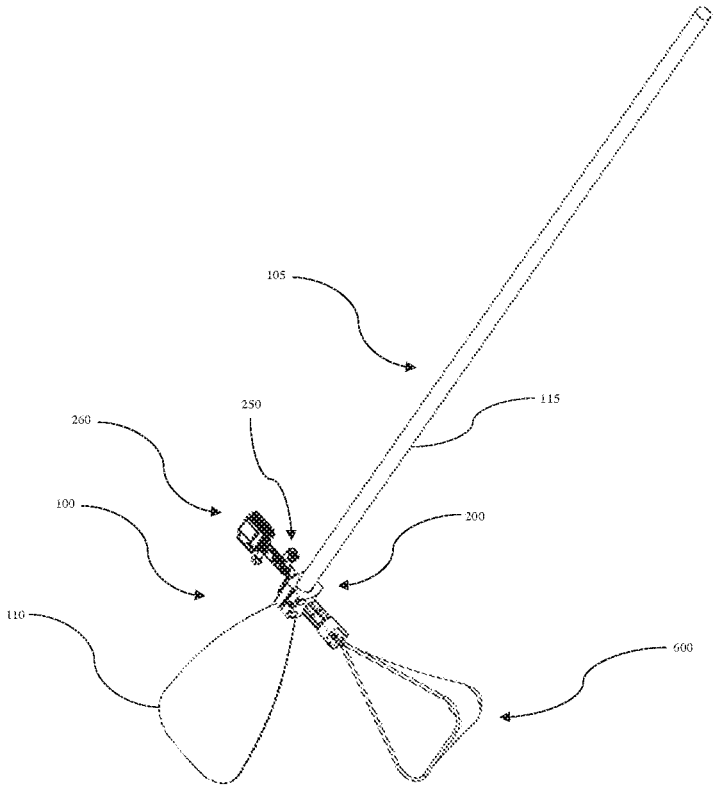
FIG. 2 is a front perspective view of the paddling apparatus, according to an example of the embodiment.

Referring now to the Figures, FIGS. 1-2 depict embodiments of the paddling apparatus 100. The paddling apparatus 100 includes a paddle 105 having a blade 110 on at least one end of a paddle shaft 115, an attachment 200 removably attachable to the paddle shaft 115, and an accessory connecting element 300 on a first side 235 of the attachment for removably connecting at least one accessory to the attachment 200. The accessory includes a training aid 400 that has a first base 405 rotatably attached with the accessory connecting element 300 and an elongated element 410 pivotally attached to the base 405.

The paddle may be a SUP paddle with a single blade on one end and a handle on the other end. The paddle may also be a paddle with blades on both ends. All paddles that can be used for propelling watercraft through the water are within the scope of this invention. Generally, the attachment is able to attach to the shaft of the paddle to allow the user to attach other devices to the paddle, so that the user can operate those devices while operating the paddle.

The paddle may be comprised of material such as carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The paddle may be formed from a single piece or from several individual pieces joined or coupled together. The components of the paddle may be manufactured from a variety of different processes including an extrusion process, a mold, welding, shearing, punching welding, folding, etc. The paddle may include a softer foam layer or grip layer or softer handle or may be made entirely from materials including, but not limited to, rubber, polymeric materials such as plastic, polyvinyl chloride (PVC) plastic, vinyl, and silicone. The components of the paddle may be of the same material or different materials and may be manufactured from the same or different processes.

Figure 3:
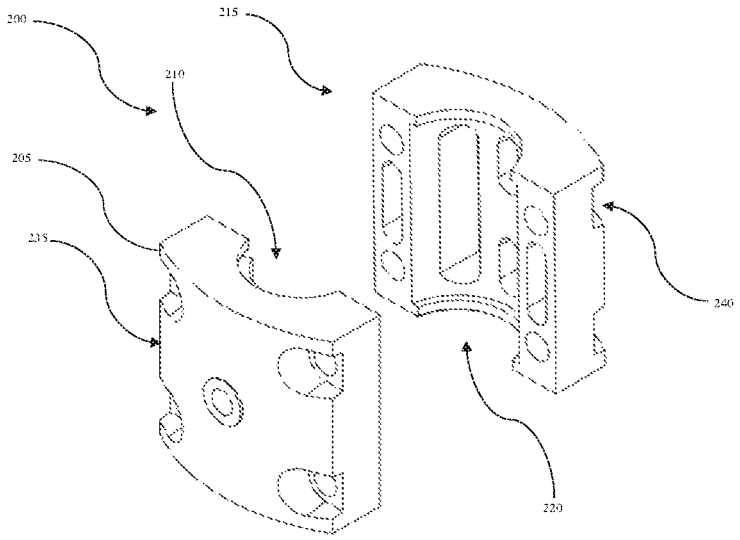
FIG. 3 is a front perspective view of the attachment of the paddling apparatus in a disassembled configuration, according to an example of the embodiment.
Figure 4:
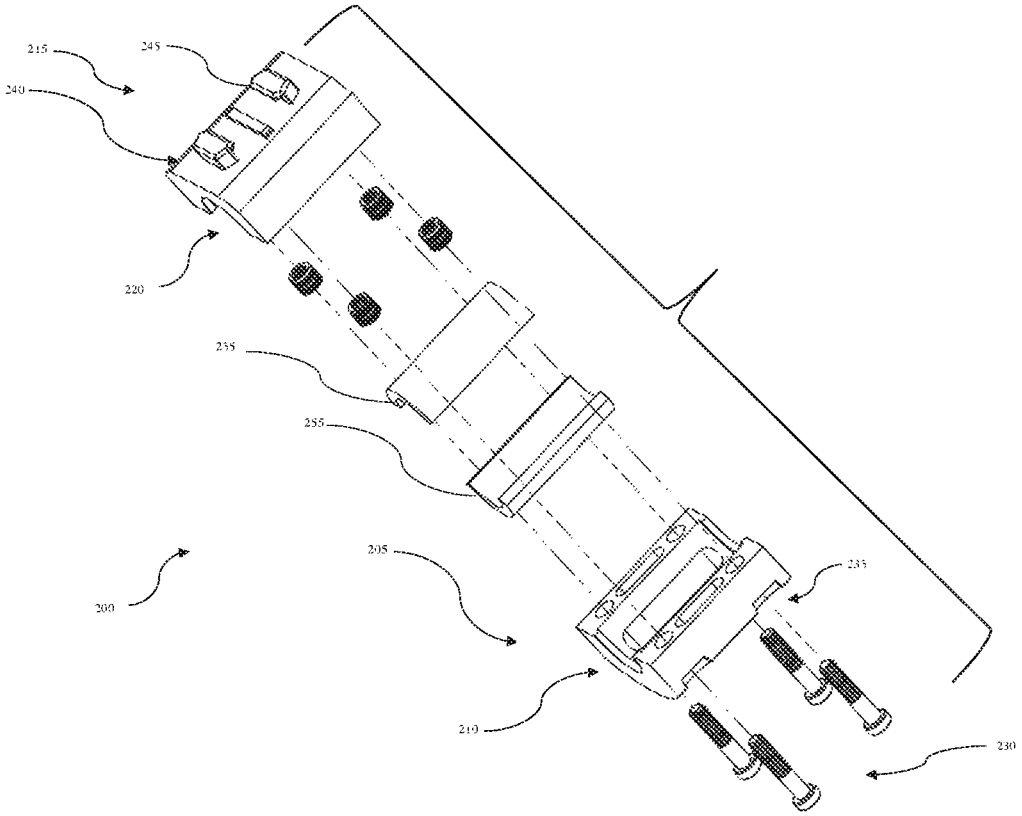
FIG. 4 is a rear perspective exploded view of the attachment of the paddling apparatus, according to an example of the embodiment.
Figure 5:
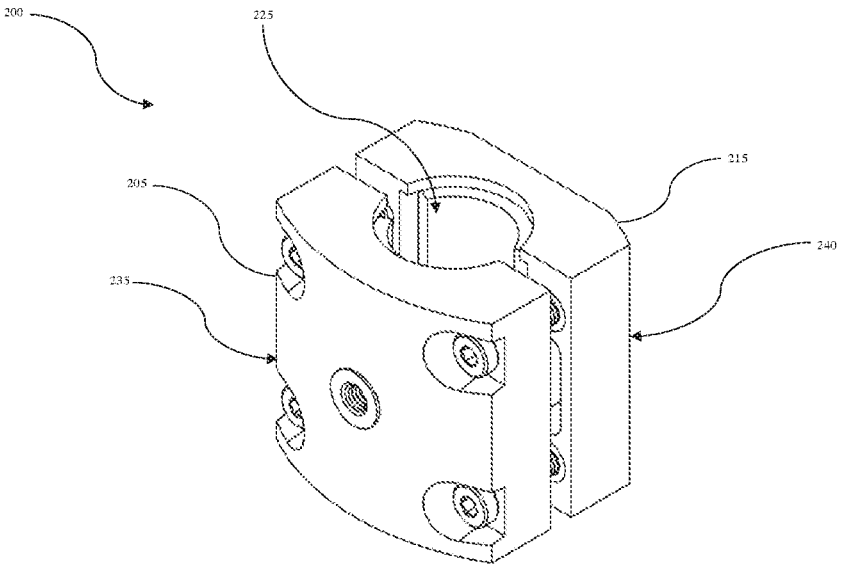
FIG. 5 is a front perspective view of the attachment of the paddling apparatus in an assembled configuration, according to an example of the embodiment.

FIGS. 3-5 show a closer view of the attachment. The attachment 200 includes a first body 205 that has a first paddle shaft shaped cutout 210 and a second body 215 that has a second paddle shaft shaped cutout 220. The first body 205 and second body 215 are configured to join with each other such that the first paddle shaped cutout and second paddle shaped cutout form a channel 225 for receiving the paddle shaft when the attachment apparatus is in an assembled configuration. The attachment also includes fasteners 230 for coupling the first body to the second body.

The attachment is a bracket, clamp, collar, or similar means to attach to the paddle shaft 115 to allow the user to attach devices or accessories to the paddle. The attachment is rectangular with outer curved surfaces as show n. However, the interior and exterior of the attachment can be rectangular, circular, triangular, or any shape, or any combinations of shapes, as long as the shape has a channel in the center to attach to the shaft of the paddle. The attachment should be as light as possible, but still be able to hold onto the paddle shaft, therefore there are notches and cutouts and chamfers to create weight-saving characteristics to the shape of the attachment. Furthermore, these weight-saving characteristics allow space for the fasteners 230, grip element 255, and a catching feature 245 (described below). The attachment may also have curved surfaces and other features to avoid having sharp corners that may injure the user.

The attachment has a first body 205 and a second body 215. This allows the user to attach and remove the attachment to the paddle shaft. FIG. 5 depicts the attachment in an assembled configuration. FIG. 3 depicts the attachment in a disassembled configuration. Each body is relatively similar in shape, but do not have to be, as long as the interior channel created by the cutouts is able to attach to the paddle. In the embodiment depicted, the first body and second body are relatively rectangular with slightly curved outer surface. However, all shapes and sizes of the first body and second body are within the scope of this invention. Furthermore, the attachment can have more than two bodies, as long as those bodies connect to form a channel and attach to a paddle.

The first body 205 has a paddle shaft shaped cutout 210 and the second body 215 has a second paddle shaft shaped cutout 220 and the two join together to form a channel 225. The paddle shaped cutouts are semi-circular in cross-sectional shape and the resulting channel is circular in cross-sectional shape because most paddle shafts are circular in cross-sectional shape. However, any shape is within the scope of the invention as long as the shape matches the cross-section of the paddle shaft that the attachment is attaching to. Furthermore, the paddle shaped cutouts and resulting channel do not have to match the paddle-shape as long as the grip element 255 (described below) is able to attach the attachment to the paddle shaft.

The fasteners for coupling the first body to the second body are threaded bolts as shown but may include a suction cup, hooks, bolt, clamps, bracket, collar, set crews, socket screws u-bolts, twine, etc. However, other types of fasteners may also be used and are within the spirit and scope of the present invention. Other methods may be used including clamps, adhesives or using tighter tolerance and pressure to hold the parts together. The adhesive may be a pressure sensitive adhesive comprising materials such as lanolin, mineral oil, petrolatum, rosin, silicone, and zinc oxide. The backing may be made of material, such as wax paper or other materials used to protect adhesive materials.

There is an accessory connecting element 300 on a first side of the attachment 235 for removably connecting an accessory to the attachment. The second side of the attachment 240 may include a second accessory connecting element. Alternatively, the second side of the attachment 240 may include a catching feature 245 for mating with a corresponding catching feature for a content capturing apparatus mount 250. The accessory connecting element is described in greater detail below. There may be more than two sides of the attachment depending on the shape and size of the attachment. In that embodiment, there may be any number of accessory connecting elements and catching features.

The accessory connecting element is described below. The catching feature 245 may be grooves cut into or extruded portions of the side of the attachment. The content capturing apparatus mount 250 has matching grooves that slide in or mate with the grooves of the catching feature. The content capturing apparatus 250 may be a camera for photography or video, an audio recorder, or something similar.

The attachment also includes a grip element 255 for attaching to the first and second paddle shaped cutouts 210 and 220 to decrease translation of the attachment relative to the paddle. The grip element may be a split sleeve, a clamp, o-ring, a wedge, or similar means for providing additional compression between the attachment and the paddle shaft. The grip element may be made up of two pieces that are semi-circular in cross section or any shape that fits the cross-section of the paddle shaft. The two pieces of the grip element may connect together via a clamp, button, insert, or similar means prior to attaching the attachment. Alternatively, the two pieces of the grip element may be held together when the fasteners of the attachment provide force between the grip element and the paddle shaft. The interior of the paddle shaped cutouts have a groove that matches the grip element, so that the attachment is less likely to move up a down the shaft. Furthermore, when the attachment attaches to the paddle shaft on the grip element, the grip element may act similar to a washer and protect the paddle shaft from the attachment being attached too tightly.

Figure 6:
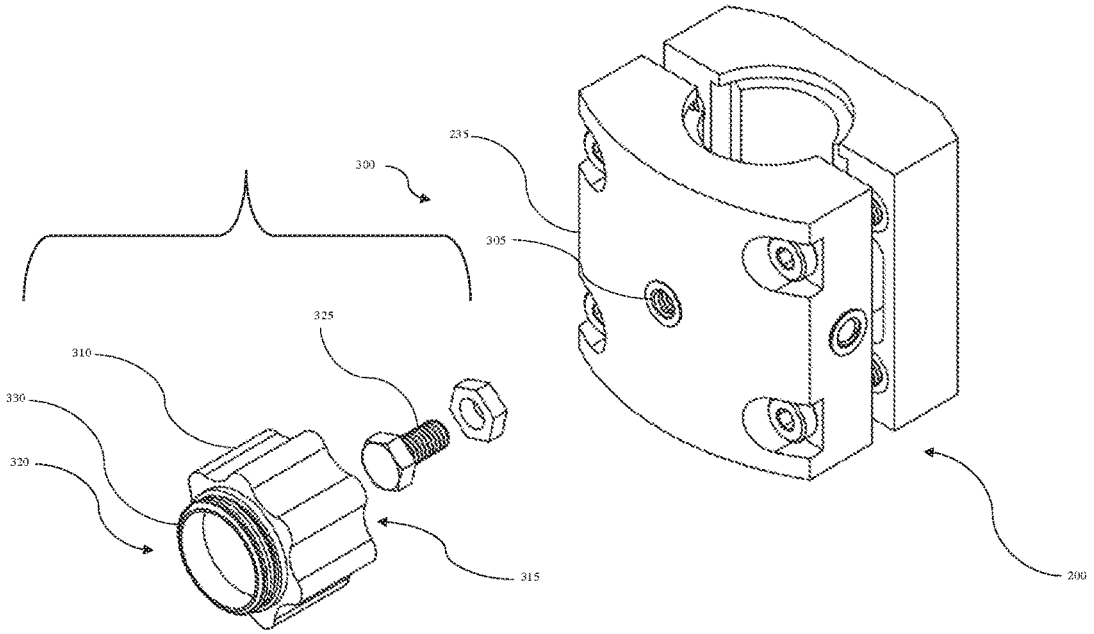
FIG. 6 is a front perspective exploded view of the knob of the accessory connecting element of the paddling apparatus, according to an example of the embodiment.

As depicted in FIG. 6, the accessory connecting element 300 includes a threaded hole 305 along the body of the attachment and a first knob 310 that has a first side 315 and a second side 320. The knob 310 is configured to attach to the threaded hole 305 by a threaded shaft 325 on the first side 315 of the first knob 310. The second side 320 of the first knob 310 has a second threaded section 330 for connecting with a third threaded portion 450 of the first base 405, a fourth threaded section 550 (outside of threaded section illustrated in FIG. 15) of the second base 505 and a fifth threaded section 650 of the third base 605 see FIG. 15). In another embodiment, the second side 320 of the knob 310 has a second threaded section 330 for connecting with a third threaded section of a base of a first accessory, which is the same as the third threaded portion 450 of the first base 405, the fourth threaded section 550 of the second base 505 and the fifth threaded section 650 of the third base 605.

The accessory connecting element 300 includes a threaded hole 305 along the body of the attachment. The threaded hole is circular and may be of any size and threading size, as long as it fits the threaded shaft 325. The threaded hole is in the center of the attachment; however, the threaded hole may be anywhere on the attachment. Additionally, as mentioned earlier, based on the size and shape of the attachment, there may be multiple threaded holes or accessory connecting elements on the attachment. There also may be additional threaded holes on each side of the attachment to attach more than one accessory.

The accessory connecting element also includes a first knob 310 that has a first side 315 and a second side 320. The outer portion of the knob is shaped as depicted, so that the user can better grip and tighten the knob along the threading. The knob is shaped similar to a star knob, but may be of any shape such as wing knob, hex bolt, circular, rectangular, etc., as long as the second side of the first knob is circular in cross-section and threaded to match bases of the accessories. The outer portion may be knurled to help the user grip the knob.

The knob 310 is configured to attach to the threaded hole 305 by a threaded shaft 325 on the first side 315 of the first knob 310. The threaded shaft on the first side of the first knob is a bolt or screw or fastener that is connected to the knob. The threaded shaft can be attached or extruded as a part of the accessory connecting element. There may be a nut or washer to protect the interior surface of the knob or the exterior surface of the attachment. Furthermore, the nut or washer may act as support to prevent the threaded shaft from moving through the opening on the knob where the threaded shaft attaches to the attachment.

The second side 320 of the first knob 310 has a second threaded section 330 for connecting with the first base, second base, and third base and their respective threaded sections. The first base, second base and third base and their respective threaded sections are described below. The second threaded section may also attach to the swivel feature described below. The second threaded section 330 is either attached or extruded from the knob. The threaded section is circular in cross-section and screws into the base of the accessories. The exterior of the second threaded section is threaded in any size as long as the threading matches the bases of the attachments or the threading of the swivel feature. The interior of the second threaded section is sized and shaped to receive the pin 810 and insert 835 described below. The interior of the second threaded section is hollow for about the length of the insert 835 (described below) at which point the interior of the first knob is solid in order to place a compressive force on the insert (described below). However, the interior of the second threaded section may also be solid if there is no swivel feature included.

Figure 7:
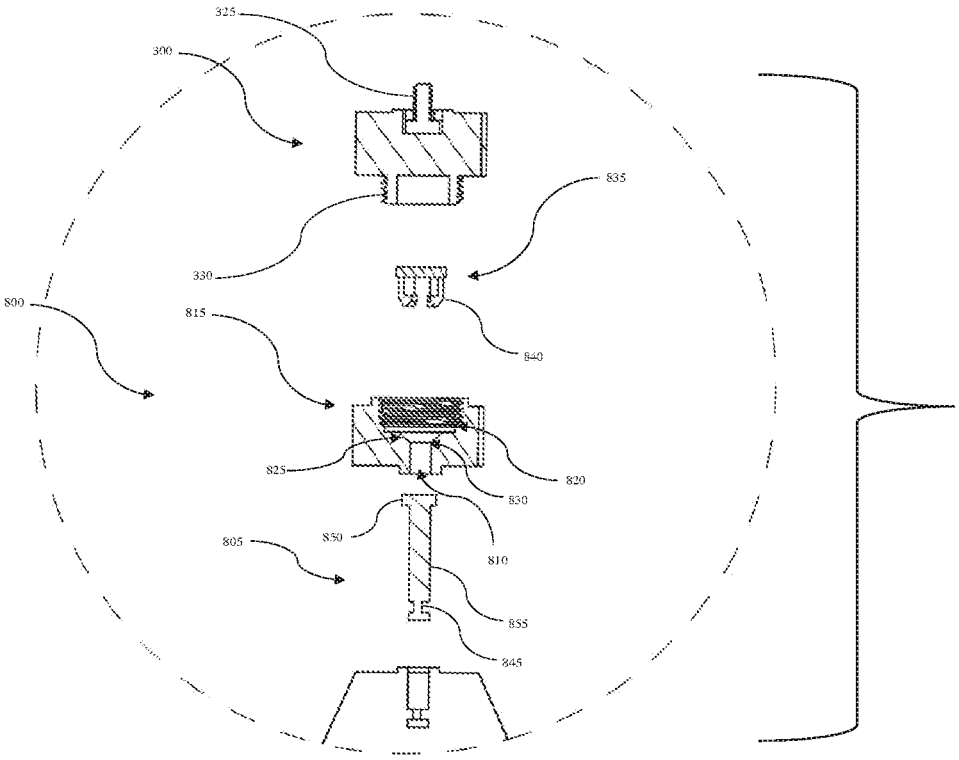
FIG. 7 is a top sectional exploded view of the accessory connecting element and swivel feature, according to an example of the embodiment.
Figure 8:
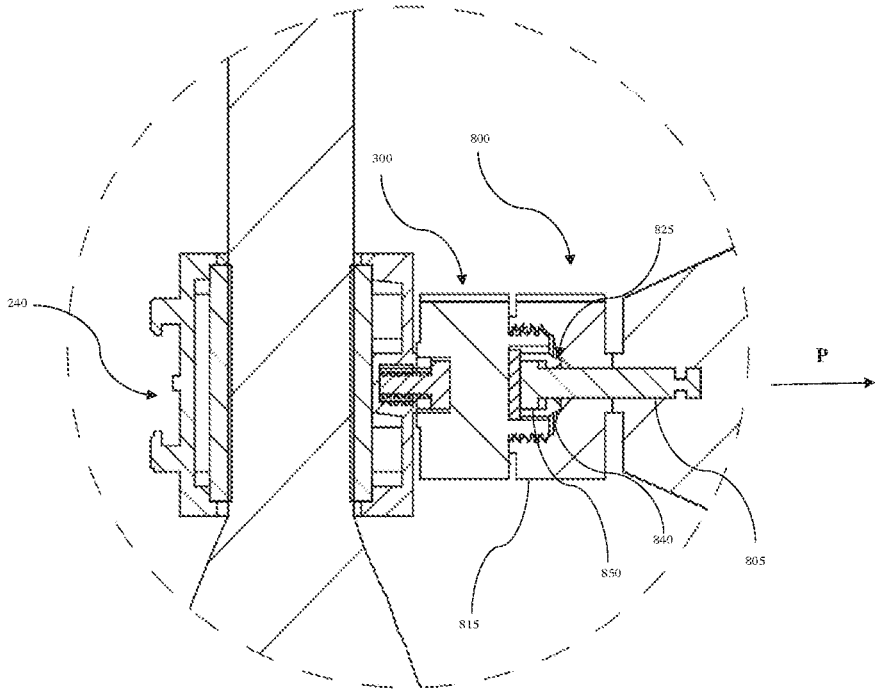
FIG. 8 is a side sectional view of the accessory connecting element and swivel feature attached to a paddle, according to an example of the embodiment.

As depicted in FIGS. 7-8, the first base 405 and third base 605 include a swivel feature 800. The swivel feature 800 includes a pin 805 configured to rotate within a channel 810 of a fourth body 815; a threaded walled opening 820 in the fourth body; an angled opening 825 in the fourth body between a first end 830 of the channel 810 and the threaded walled opening 820, and an insert 835 having a plurality of legs 840. The insert 835 is configured for the legs 840 to be received within the threaded walled opening 820 and angled opening 825 such that the legs are moved inward when forces move the insert into the wall opening.

The swivel feature includes a pin 805 configured to rotate within a channel 810 of a fourth body 815. The pin may be a fastener or bolt and is circular in cross section. The pin may be attached or may be extruded from the first or third base of the accessories. On one end, the pin has a notch 845 that fits into the base of the accessory. On the other end, the pin has a head 850 with a larger diameter than the rest of the shaft 855 of the pin. The shaft 855 of the pin is sized to fit through the channel 810 and fit into the base of the accessory. The diameter of the head of the pin is larger than the diameter of channel 810 to prevent the pin from exiting the channel.

The fourth body may be of a shape similar to the knob 310. However, the fourth body may be of any shape or size as long as the threaded walled opening 820 of the interior of the fourth body matches the threading on the exterior of the knob 310. The swivel feature 800 includes a threaded walled opening 820 in the fourth body. This threaded walled opening is intended to screw on the threaded section 330 of the base. The exterior of the threaded walled opening is threaded and the interior is hollow, with a diameter larger than the head of the pin. Between the first end 830 of the channel 810 and the threaded walled opening 820, there is an angled opening 825. The angled opening tapers or chamfers the diameter of the opening from the interior of the threaded walled opening, which is larger than the diameter of the head of the pin, to the diameter of the channel 810, which is smaller than the diameter of the head of the pin.

The swivel feature 800 includes an insert 835 having a plurality of legs 840. On the one end of the insert, the legs 840 are configured to fit around the head 850 of the pin 805 and grasp the head of the pin with notches on the bottom of the legs that hold the bottom of the head of the pin. The notches at the bottom of the legs of the insert are sized to touch or almost touch the shaft 855 of the pin 805. The legs are designed to flex inward as a force is applied to the exterior of the legs. One the other end of the insert, the insert is sized to fit within interior of the second threaded section 330 of the accessory connecting element. The insert 835 is configured for the legs 840 to be received within the threaded walled opening 820 and angled opening 825 such that the legs are moved inward when forces move the insert into the wall opening (direction of line P in FIG. 8). As the threaded walled opening 820 of the fourth body is screwed onto second threaded section 330 of the accessory connecting element, an interior surface of the knob pushes the legs of the insert, which causes the legs to grasp the head of the pin, into the angled opening 825. This causes the legs of the insert to tighten around the shaft of the pin to prevent the pin from rotating. Thus, the user can choose the position of the base of the device then tighten the swivel feature and accessory connecting element so that accessory can no longer rotate.

The attachment, grip element, accessory connecting element, and swivel feature may be comprised of material such as foam rubber, plastic, polyvinyl chloride (PVC) plastic, vinyl, silicone, carbon steel, stainless steel, aluminum, Titanium, other metals or alloys, composites, ceramics, polymeric materials such as polycarbonates, such as Acrylonitrile butadiene styrene (ABS plastic). Lexan™, and Makrolon™. The attachment, grip element, accessory connecting element, and swivel feature may be formed from a single piece or from several individual pieces joined or coupled together. The attachment, grip element, accessory connecting element, and swivel feature may be manufactured from a variety of different processes including an extrusion process, a mold, welding, shearing, punching welding, folding, etc. The components of the attachment, grip element, accessory connecting element, and swivel feature may be of the same material or different materials and may be manufactured from the same or different processes.

As depicted in FIGS. 1-2 and 9-19, the paddling apparatus kit may include a plurality of removable accessories for connecting to the attachment 200 by the accessory connecting element 300. The removable accessories include: (1) a training aid 400 that has a first base 405 rotatably and removably attachable to the accessory connecting element 300 and an elongated element 410 pivotally attached to the base 405; (2) a lighting element 500 that has a second base 505 configured for connecting and/or removably attachable with the attachment 200 by the accessory connecting element 300; and (3) a net 600 that has a third base 605 rotatably and removably attachable to the attachment 200 by the accessory connecting element 300.

In another embodiment of the invention, the paddling apparatus kit includes a first accessory and a second accessory for removably attaching to the attachment by the accessory connecting element. In this embodiment of the invention, the first accessory includes the training aid, the lighting element or the net and the second accessory includes the weighted element. However, the first and second accessories may also include any of the four accessories listed above.

Figure 12:
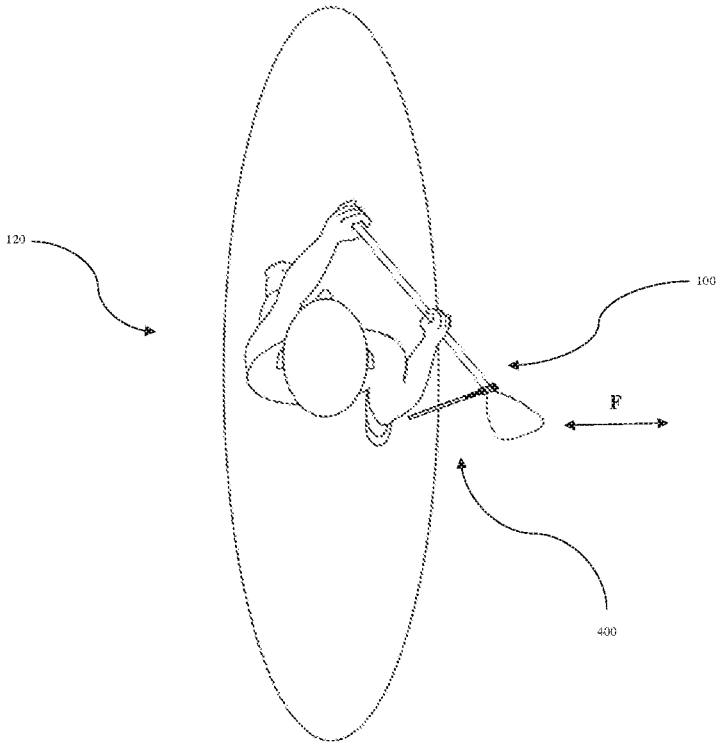
FIG. 12 is a top view of the paddling apparatus in a training configuration at the maximum stroke point, according to an example of the embodiment.
Figure 13:
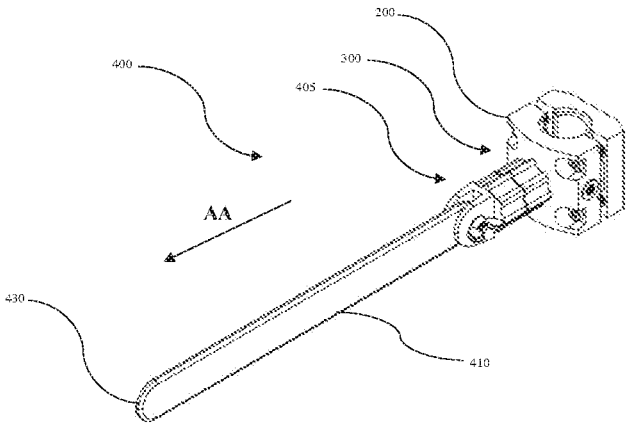
FIG. 13 is a front perspective view of the training aid in a training configuration, according to an example of the embodiment.
Figure 14:
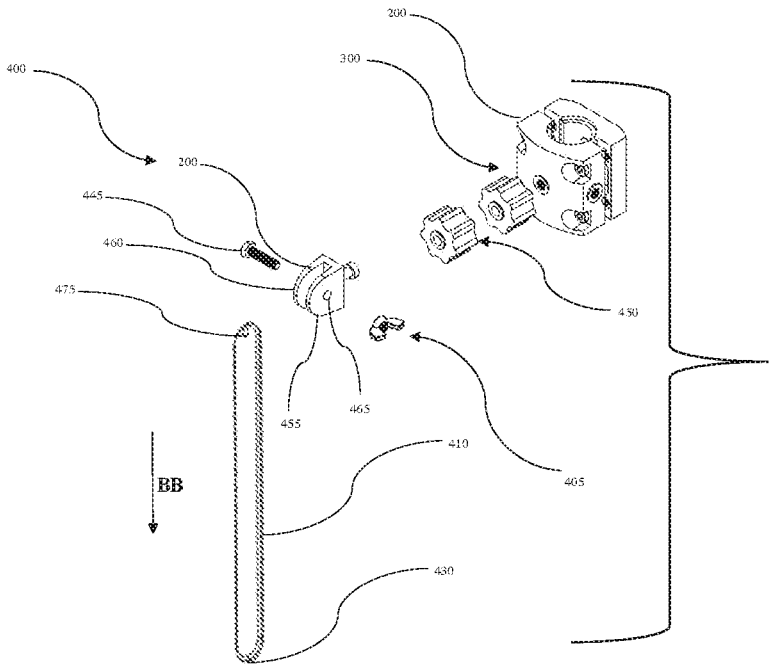
FIG. 14 is a front perspective exploded view of the training aid in a non-training configuration, according to an example of the embodiment.

Referring to FIGS. 9-14, the training aid 400 is used to train the user to have an efficient stroke while operating the paddle. Referring to FIGS. 13-14, the training element has an elongated element 410, which is pivotally attached to the base 405. The elongated element may be rectangular, circular or any shape. The elongated element may be a shim or a thin piece of material or may be thicker dependent on the user's specifications and preferred strength or hardness of the material. Preferably, the elongated element should be soft with no sharp edges to avoid any injury to the user. However, the user may wish to have an elongated element that is stronger or more rigid, so that the elongated element lasts longer or the user can better feel when the elongated element touches their leg.

Again referring to FIGS. 13-14, the training aid attaches to the accessory connecting element via a first base 405. The first base has the third threaded portion. The third threaded section is circular in cross section and has threading to match the threading on the accessory connecting element. There may be a pin 805 that is attached to or extruded from the first base as described above. The pin is used as a part of the swivel feature to orient the training aid in the desired position.

As depicted in the figures, the base includes two parallel walls 455 and 460, so that the elongated element can fit between the parallel walls. The distance between the parallel walls may be sized so that elongated element touches the interior of both parallel walls. The distance between the parallel walls may also be sized larger than the thickness of the elongated element, but the parallel walls may be able to flex so that the elongated element touches the interior of the parallel walls once fastened. The parallel walls fit tightly around the elongated element to hold the element in place, but still allow the elongated element to rotate around the fastener 445. The parallel walls have a hole 465 in the center of each wall, which line up with a hole 475 in the elongated element. A fastener or bolt 445 is placed through a hole in one of the parallel walls through the hole in the elongated element and through the hole in the second parallel wall, so that the elongated element can be secured to the parallel walls, but still move pivotally relative to the fastener. The fastener or bolt is fastened in place, most likely via a nut as depicted. The parallel walls are semicircular, which makes it easier to rotate the elongated element; however, the parallel walls may be of any shape. Furthermore, there may only be one wall on the first base, as long as the elongated element can be fastened to the wall and move pivotally with respect to that wall.

Referring to FIGS. 9-12, the training aid 400 is configured to move between a training configuration, where the elongated element is oriented generally in the direction of line AA in FIG. 13, and a non-training configuration, where the elongated element is oriented generally in the direction of line BB in FIG. 14. In the training configuration, a terminal end 430 of the elongated element 410 is positioned relative to the base 405 and attached to the paddle shaft 115, such that the elongated element contacts a paddler 120 at a maximum stroke point, line F on FIG. 12. In the non-training configuration, the terminal end of the elongated element is positioned relative to the base and attached to the paddle shaft, such that the elongated element does not contact the paddler at the maximum stroke point.

FIGS. 9-13 depict the training aid a training configuration. In the training configuration, the elongated element of the training aid is pointed relatively perpendicular to the paddle shaft or generally in the direction of line AA in FIG. 13. At the initial stroke point, line E on FIG. 11, the paddler places the paddle in the water in the direction of line A on FIG. 9 and pushes the paddle backwards in the direction of line B on FIGS. 9 and 11 to propel the SUP forward. Thus, as the paddler brings the paddle back towards their self to move the SUP forward from an initial stroke point, line E on FIG. 11, the training aid touches the leg of the paddler when the paddle is parallel to the user's legs. The point at which the training touches the leg of the paddler, line F on FIG. 12, is the maximum stroke point. The initial stroke point is the point at which the paddle touches the water. The initial stroke point is dependent on how tall the user is, the length of the user's arms, the size of the SUP, the size of the paddle, the stance of the paddler, etc. Thus, the initial stroke point will not be the same for every stroke or paddler.

Figure 9:
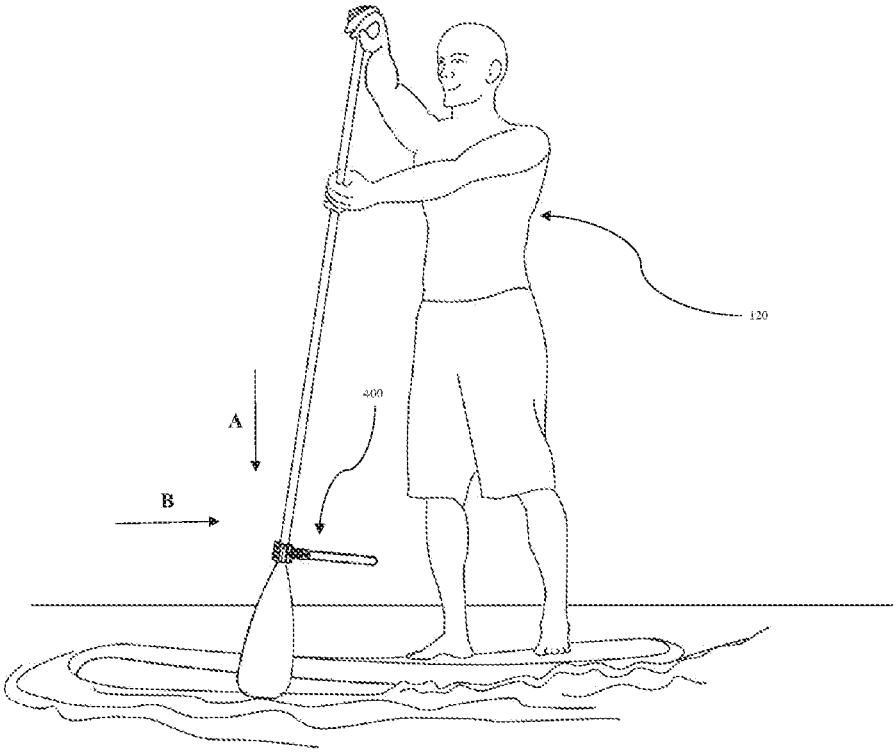
FIG. 9 is a front perspective view of the paddling apparatus in a training configuration at the initial stroke point, according to an example of the embodiment.
Figure 10:
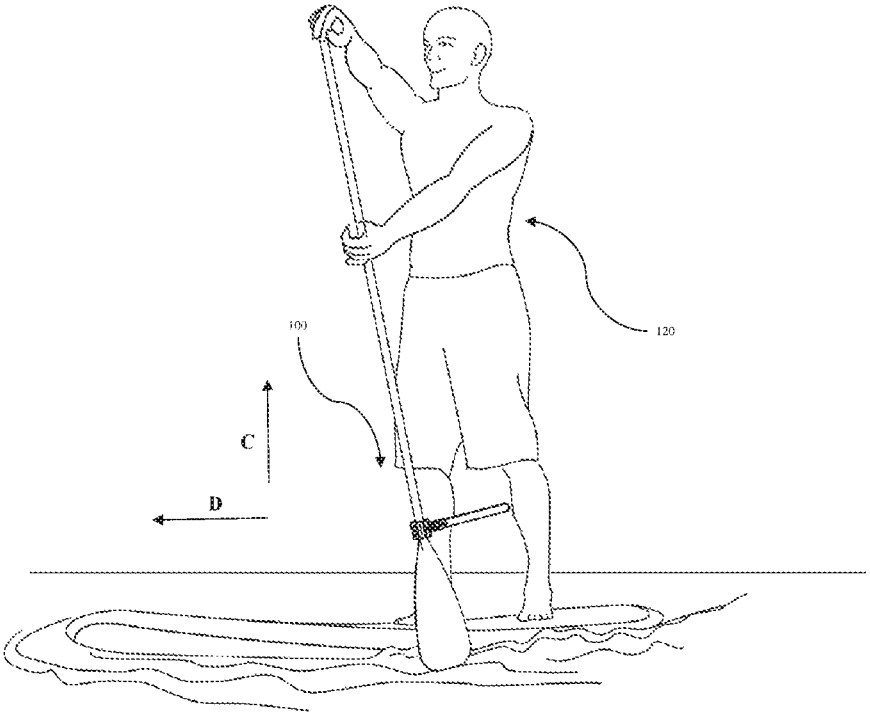
FIG. 10 is a front perspective view of the paddling apparatus in a training configuration at the maximum stroke point, according to an example of the embodiment.
Figure 11:
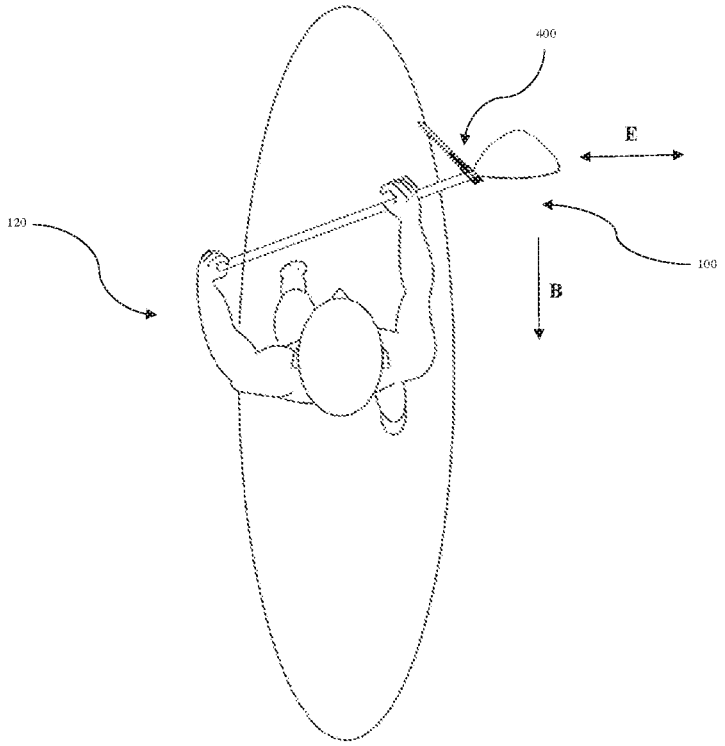
FIG. 11 is a top view of the paddling apparatus in a training configuration at the initial stroke point, according to an example of the embodiment.

The training aid alerts the user when they have reached the maximum stroke point by touching the paddler's leg. The maximum stroke point, line F on FIG. 12, or when the paddle is just in front of the paddler's legs, is considered the most efficient point to end the stroke. At the maximum stroke point, the paddler removes the paddle from the water in the direction of line C on FIG. 10, moves the paddle forward in the direction of line D on FIG. 10 and begins the next stroke at a new initial stroke point, as shown in FIG. 9. Generally, the training aid is to teach the paddler to do all paddling in front of their body because paddling in front of your body is considered the most efficient way to paddle.

FIG. 14 depicts the training aid in a non-training configuration. In the non-training configuration, the elongated element of the training aid is pointed relatively parallel to the paddle shaft or generally in the direction of line BB in FIG. 14. Thus, unlike the above scenario, as the paddler brings the paddle back to the maximum stroke point, where the paddle is parallel with the user's legs, the elongated element does not contact the paddler at the maximum stroke point. Thus, the user can put the training aid in a non-training configuration without having to fully remove the training aid from the attachment. In this scenario, the user can determine whether they have developed the motor skills to make sure they are always paddling in front of their body. Otherwise, the user should reengage the training aid in the training configuration, so that the user learns their maximum stroke point.

Figure 15:
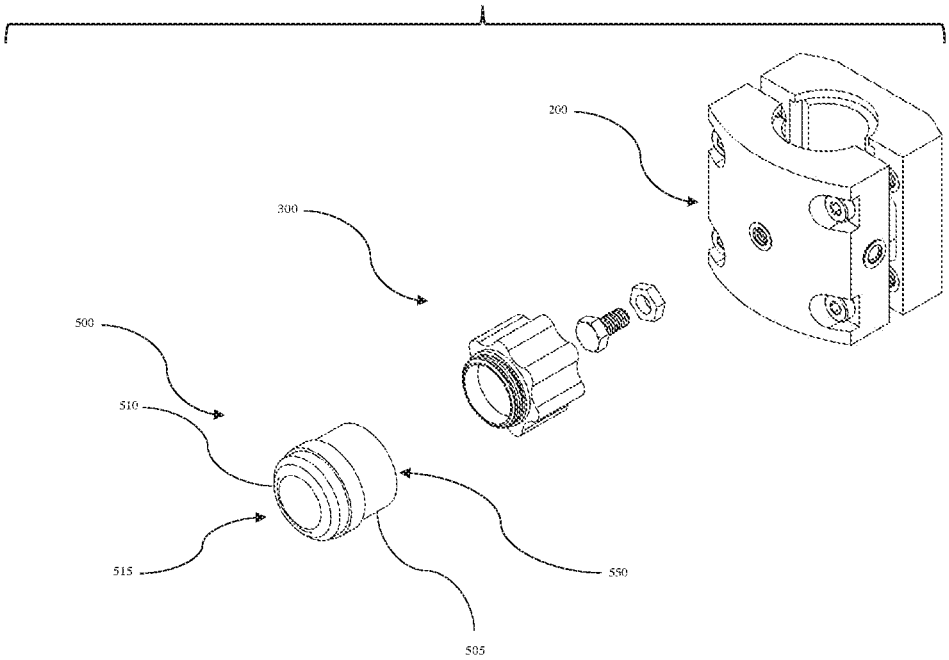
FIG. 15 is a front perspective exploded view of the lighting element, according to an example of the embodiment.
Figure 16:
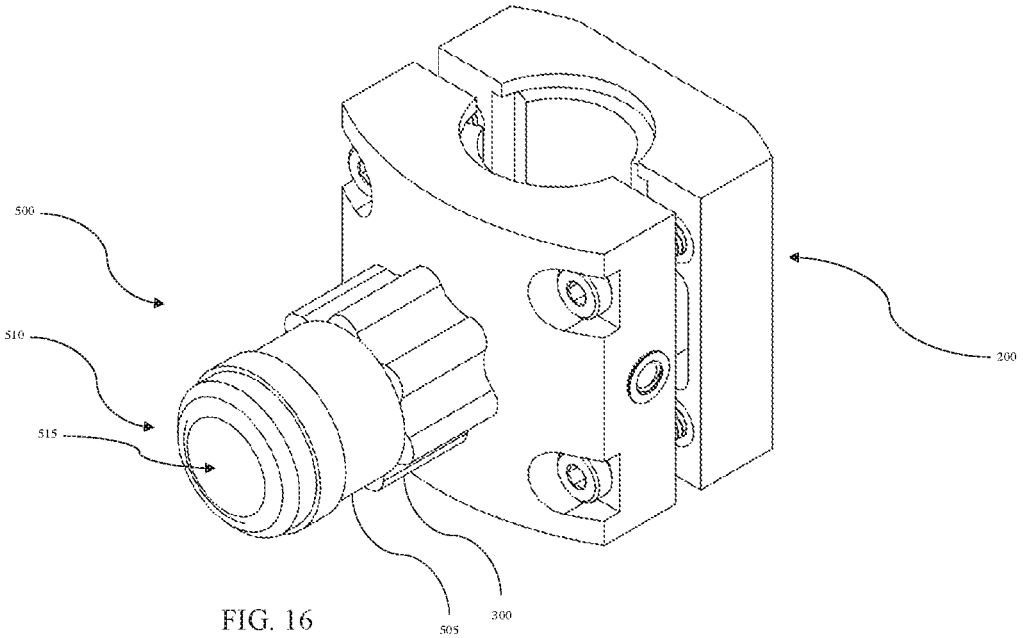
FIG. 16 is a front perspective view of the lighting element, according to an example of the embodiment.

Referring to FIGS. 15-16, the paddling apparatus includes the lighting element 500 so that user can operate a light while operating the paddle. The lighting element includes a housing 510 and a light emitter 515. The housing holds the light emitter, so that it can be attached to the attachment via its second base as the accessory connecting element. The housing is circular in cross-section, however the housing can be any shape or size, such as rectangular, as long as the housing can hold the lighting element. Ideally, the lighting element and housing should remain as light as possible, so there is less added weight to the paddle. The light emitter 515 may utilize Light Emitting Diode, incandescent, fluorescent, halogen or any lighting type. The housing should seal the light emitter, so that the lighting element is waterproof. The user can turn on the lighting element by a switch or button on the lighting element. The lighting element can be battery powered or have an internal rechargeable device.

The lighting element 500 has a second base 505 configured for removably attaching with the attachment 200 by the accessory connecting element 300. The second base has the fourth threaded section 550 as mentioned above. The exterior of the second base is shaped in a cylindrical shape, however it may be of an exterior shape. The shape of the interior of the second base is circular in cross section and has the fourth threaded section to match the threading on the accessory connecting element. This allows the user to attach the lighting element to accessory connecting element by screwing the fourth threaded section onto the exterior threaded section of the accessory connecting element.

Figure 17:
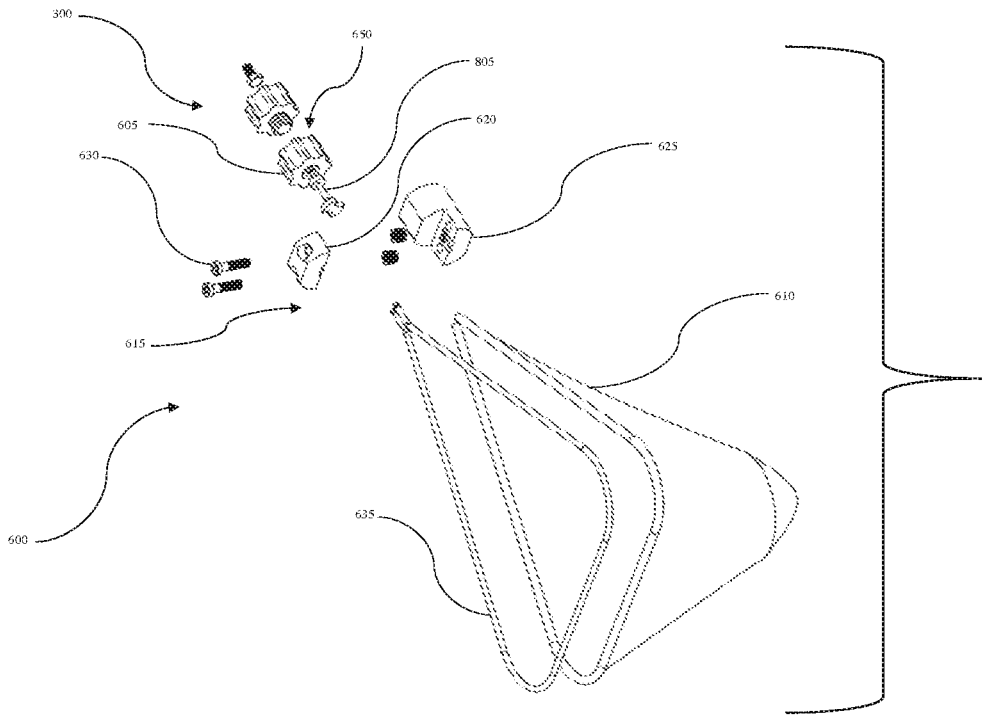
FIG. 17 is a front perspective exploded view of the net, according to an example of the embodiment.

Referring to FIG. 17, the net 600 is available so that the user can operate a net to remove items from the water while operating the paddle. The net includes a net element 610, a third base 605 with a net housing 615, and fasteners 630 to connect the net element to the third base.

The net element is a porous material that allows water to drain, but can pick up debris at the same time. The net element is triangular in cross-sectional shape, however the net element can be any shape and size. The net element has a rigid upper portion 635 that holds the porous portion of the net element. The rigid upper portion may fit through a sleeve in the porous portion or the porous portion may wrap around the rigid portion and be held together by the third base or net housing. The net element may be made of materials and processes as listed below or may also be made of string, nylon, or any materials that can be made porous so that water can escape but debris remains inside the net.

The net 600 has a third base 605 rotatably and removably attachable to the attachment 200 by the accessory connecting element 300. The third base has a fifth threaded section 650 as mentioned above. The fifth threaded section is circular in cross section and has threading to match the threading on the accessory connecting element. There may be a pin 805 that is attached to or extruded from the third base and the pin is described above. The pin 805 is used as a part of the swivel feature to orient the net in the desired direction. The third base 605 has a net housing portion 615. The net housing portion has an upper portion 620 that holds the net element 610 in place against a lower portion 625 of the net housing with fasteners 630. The net housing portion of the third base is circular in cross-section shape when the upper portion is attached. The upper portion is notch that is semi-circular in cross section that is cut out of the net housing with threaded holes for the fasteners to attach the two portions of the net housing. However, the net housing can be any shape, as long as it holds the net element and attaches the base 605 to the accessory connecting element.

The fasteners 630 for coupling the net element and net housing are threaded bolts as shown but may include a suction cup, hooks, bolt, clamps, bracket, collar, set crews, socket screws u-bolts, twine, etc. However, other types of fasteners may also be used and are within the spirit and scope of the present invention. Other methods may be used including clamps, adhesives or using tighter tolerance and pressure to hold the parts together. The adhesive may be a pressure sensitive adhesive comprising materials such as lanolin, mineral oil, petrolatum, rosin, silicone, and zinc oxide. The backing may be made of material, such as wax paper or other materials used to protect adhesive materials.

Figure 18:
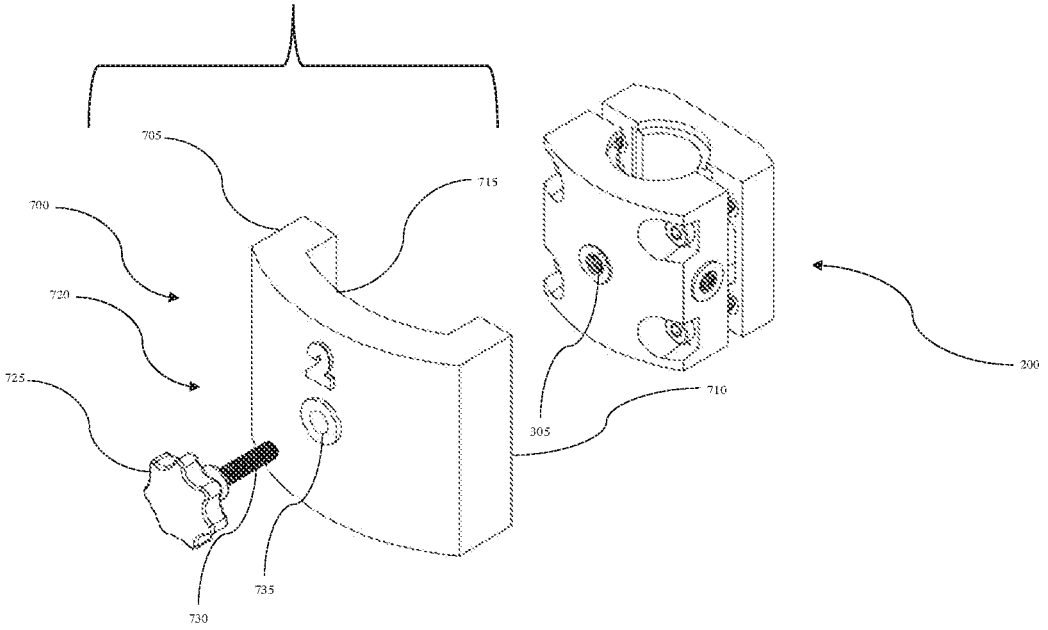
FIG. 18 is a front perspective exploded view of the weighted element, according to an example of the embodiment.

Referring to FIG. 18, the removable accessories also may include a weighted element or weight 700. The weight 700 includes two opposing wall sections 705 and 710 and a curved surface 715 spanning the wall sections. The wall sections are configured to straddle the attachment 200 such that the curved surface abuts a first side 235 of the attachment when the weight is coupled to the attachment. The weight includes a weighted or heavy object 720 for increasing an amount of force required to move the paddle when the weight is attached to the paddling apparatus 100.

The weight can be attached similar to the other accessories. However, in another embodiment, the accessory connecting element also includes a second knob 725 that has a threaded shaft 730. The threaded shaft 730 is configured to pass through an opening 735 in a second accessory and mate with the threaded hole 305 of the attachment, such that when the second accessory is positioned between the second knob and coupled with the attachment the second knob retains the second accessory on the attachment. The second knob 725 may be of the same types of shapes as the first knob 310.

The weighted element or weight 700 is specifically for the user's stroke strength training aspect of the invention. The weight has two opposing wall sections 705 and 710 and a curved surface 715 spanning the wall sections that are configured to straddle the attachment 200. The wall sections are rectangular in cross section and the interior of the wall section matches the exterior of the attachment. Similarly, the curved surface 715 matches the exterior curved surface of the attachment. Thus, the weight is close to or touching the surface of the attachment. The wall sections and curved surface may be different shapes to dependent on the shape of the attachment. The weight 700 may have a hole or opening 735, which may or may not be threaded, in the center of the weighted element allows the accessory connecting element 300 to connect the weighted element 700 to the attachment 200. Here, the threaded shaft of the accessory connecting element is put through the hole of the weighted element and screws into the threaded hole 305 of the attachment.

The weighted element or weight also has a weighted or heavy object 720, which is for increasing the weight of the paddle, so that the paddler may build strength and endurance from using a heavier paddle. The heavy object can be made up of materials as listed below or may be made of iron or filled with water, sand or a similar mixture. The weighted objected may be adjustable in weight by filling the weighted object to the desired level with one of the materials. Alternatively, the weighted objected and weighted element may come in different sizes, shapes, or weights, so that the user can select the weight they wish to use. The weight of the weighted element will be dependent on the weight of the weighted object within the weighted element.

The training aid, lighting element, net, and weighted element may be comprised of material such as foam rubber, plastic, polyvinyl chloride (PVC) plastic, vinyl, silicone, carbon steel, stainless steel, aluminum, Titanium, other metals or alloys, composites, ceramics, polymeric materials such as polycarbonates, such as Acrylonitrile butadiene styrene (ABS plastic), Lexan™, and Makrolon™. The components may be formed from a single piece or from several individual pieces joined or coupled together. The components may be manufactured from a variety of different processes including an extrusion process, a mold, welding, shearing, punching welding, folding, etc. The components may be of the same material or different materials and may be manufactured from the same or different processes.

In operation, generally a user would mount the attachment to the shaft of the paddle where the attachment would remain attached to the paddle shaft. The user attaches the attachment to the paddle shaft by abutting the grip element of the sides of the attachment with the paddle shaft. Next, the user then connects the two sides of the attachment to the paddle via the fasteners. After the attachment is securely attached to the paddle, the user attaches the accessory to the accessory connecting element or the catching feature. For the accessory connecting element, the user can screw the base of the accessory onto the accessory connecting element and then screw the accessory connecting element into the threaded hole on the attachment. When using the swivel feature the user, rotates the pin and base of the accessory to their desired position then the user screws the swivel feature onto the accessory connecting element which causes the insert to lock the pin in position. For the catching feature, the user slides the mating grooves of the content capturing apparatus mount onto the mating grooves of the catching feature.

Figure 19:
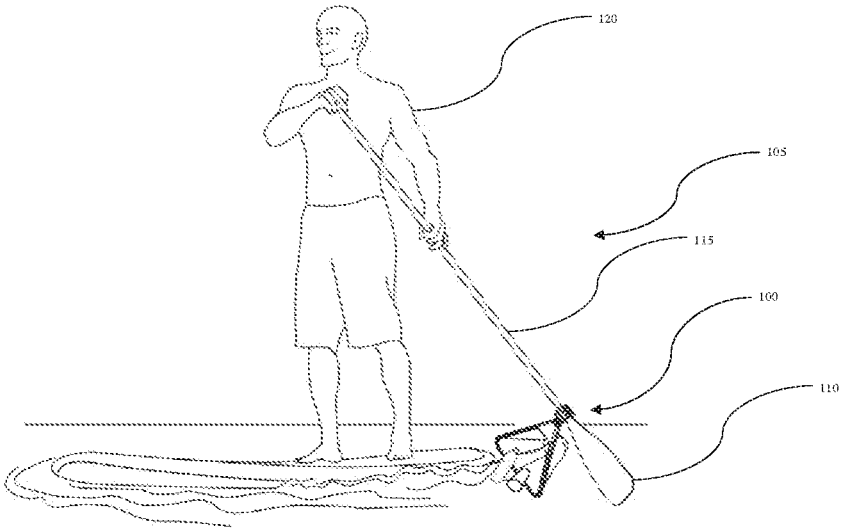
FIG. 19 is a front perspective view of a user operating the paddling apparatus, according to an example of the embodiment.

Once the accessory is secure to the paddle, the user can then efficiently and effectively use that accessory while operating the paddle. As seen in FIG. 19, the user can use the net to clean debris or scoop items out of the waterway; the content capturing apparatus for capturing content; the lighting element to operate the paddle-driven watercraft at night or capturing content underwater; the training aid for stroke efficiency training; and the weighted element for stroke strength training.

More specifically, the training aspect of the embodiment has two parts: stroke strength training and stroke efficiency training. The stroke strength training is the ability to add a weight via the weighted element to the paddle to increase resistance and build strength and endurance. In this aspect of the invention, the disclosed embodiment has a device an individual could use to train for a race or just to add an alternative exercise to a workout regiment. By using a weighted paddle attachment to train before a race, on race day the user can remove the weight and fly through the course.

Referring to FIGS. 9-12, the stroke efficiency training is the ability to use the training aid. The training aid or training shims will be attached to the attachment to the paddle and stick out to hit the paddler at preferably about ankle to shin-height when paddling. When the paddler feels the shim, the paddler knows it is time to remove the paddle from the water and start a new stroke. The goal behind stroke efficiency training is to help paddlers build the motor skills many coaches say is the optimum range of motion for a paddle stroke on a SUP. Generally, all of the paddling should be done in front of the paddler. Once the paddle gets to the user's feet, or in this case, the training aid touches the user's leg, the user removes the paddle from the water and begins a new stroke. Paddlers will use the training shims to improve their stroke, range of motion and motor skills, thereby not wasting unnecessary energy by paddling incorrectly.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A standing paddleboard paddling training apparatus comprising:

a paddle having a blade on at least one end of a paddle shaft;

an attachment removably attachable to the paddle shaft;

an accessory connecting element on a first side of the attachment for removably connecting at least one accessory to the attachment, wherein an accessory comprises a training aid that comprises:

a base rotatably attached with the accessory connecting element;

an elongated element having a first end and a second end;

wherein the first end of the elongated element is pivotally attached to the base such that the elongated element pivots at least 90 degrees relative to the base such that the elongated element moves between a training configuration and a non-training configuration;

wherein in the training configuration the elongated element's longitudinal axis is perpendicular to the longitudinal axis of the paddle shaft; and, wherein in the non-training configuration the elongated element's longitudinal axis is not perpendicular such that a terminal end of the elongated element is proximate to the paddle shaft.

2. The standing paddleboard paddling training apparatus of claim 1, wherein the attachment comprises:

a first body having a first paddle shaft shaped cutout;

a second body having a second paddle shaft shaped cutout;

wherein the first body and second body are configured to join with each other such that the first paddle shaped cutout and second paddle shaped cutout form a channel for receiving the paddle shaft when the attachment apparatus is in an assembled configuration; and, fasteners for coupling the first body to the second body.

3. The standing paddleboard paddling training apparatus of claim 2, wherein the attachment further comprises a grip element for attaching to the first and second paddle shaped cutouts to decrease translation of the attachment relative to the paddle.

4. The standing paddleboard paddling training apparatus of claim 1, wherein the training aid is configured to move between the training configuration and the non-training configuration, wherein in the training configuration the terminal end of the elongated element is positioned relative to the base and attached to the paddle shaft defining a length such that the elongated element contacts a leg of a paddler in the standing position on a paddleboard at a maximum stroke point; and, wherein in the non-training configuration the terminal end of the elongated element is positioned relative to the base and attached to the paddle shaft defining a length such that the elongated element does not contact the leg of the paddler in the standing position on the paddleboard at the maximum stroke point.

5. The standing paddleboard paddling training apparatus of claim 1, wherein a second side of the attachment comprises a catching feature for mating with a corresponding catching feature for a content capturing apparatus mount.

6. A standing paddleboard paddling training apparatus kit comprising:

a paddle having a blade on at least one end of a paddle shaft;

an attachment removably attachable to the paddle shaft;

an accessory connecting element on a first side of the attachment for removably connecting an accessory to the attachment;

a plurality of removable accessories for connecting to the attachment by the accessory connecting element, wherein the removable accessories comprise, a training aid having a first base rotatably and removably attachable to the accessory connecting element and an elongated element having a first end and a second end;

wherein the first end of the elongated element is pivotally attached to the first base such that the elongated element pivots at least 90 degrees relative to the first base; wherein in a training configuration the elongated element's longitudinal axis is perpendicular to the paddle shaft's longitudinal axis; and, wherein in a non-training configuration the elongated element's longitudinal axis is not perpendicular such that a terminal end of the elongated element is proximate to the paddle shaft;

a lighting element having a second base configured for removably connecting with the attachment by the accessory connecting element; and, a net having a third base rotatably and removably attachable to the attachment by the accessory connecting element.

7. The standing paddleboard paddling training apparatus kit of claim 6, wherein the attachment comprises:

a first body having a first paddle shaft shaped cutout;

a second body having a second paddle shaft shaped cutout;

wherein the first body and second body are configured to join with each other such that the first paddle shaped cutout and second paddle shaped cutout form a channel for receiving the paddle shaft when the attachment apparatus is in an assembled configuration;

fasteners for coupling the first body to the second body; and, a grip element for attaching to a portion of the first and second paddle shaped cutouts to decrease translation of the attachment relative to the paddle.

8. The standing paddleboard paddling training apparatus kit of claim 6, wherein the accessory connecting element comprises:

a threaded hole along the body of the attachment;

a first knob having a first side and a second side, the knob configured to attach to the threaded hole by a threaded shaft on the first side of the first knob, the second side of the first knob having a second threaded section configured for connecting with connecting with a third threaded section of the first base, fourth threaded section second base and a fifth threaded section third base.

9. The standing paddleboard paddling training apparatus kit of claim 6, wherein the training aid is configured to move between a training configuration and a non-training configuration, wherein in the training configuration a terminal end of the elongated element is positioned relative to the base and attached to the paddle shaft defining a length such that the elongated element contacts a leg of a paddler in the standing position on a paddleboard at a maximum stroke point; and, wherein in the non-training configuration the terminal end of the elongated element is positioned relative to the base and attached to the paddle shaft defining a length such that the elongated element does not contact the leg of the paddler in the standing position on the paddleboard at the maximum stroke point.

10. The standing paddleboard paddling training apparatus kit of claim 9, wherein the first base and third base comprises a swivel feature comprising:

a pin configured to rotate within a channel of a fourth body;

a threaded walled opening in the fourth body;

an angled opening in the fourth body between a first end of the channel and the threaded walled opening; and, an insert having a plurality of legs, the insert configured for the legs to be received within the threaded walled opening and angled opening such that the legs are moved inward when forces move the insert into the walled opening.

11. The standing paddleboard paddling training apparatus kit of claim 6, wherein the removable accessories further comprises a weight comprising:

two opposing walled sections;

a curved surface spanning the walled sections;

the walled sections configured to straddle the attachment such that the curved surface abuts a first side of the attachment when the weigh is coupled to the attachment; and, wherein the weight comprises a heavy object for increasing an amount of force required to move the paddle when the weight is attached to the paddling apparatus.

12. A standing paddleboard paddling training apparatus kit comprising:

a paddle having a blade on at least one end of a paddle shaft;

an attachment removably attachable to the paddle shaft;

an accessory connecting element on a first side of the attachment for removably connecting a first accessory and a second accessory to the attachment;

wherein the accessory connecting element comprises:

a threaded hole along a first side of the attachment;

a first knob having a first side and a second side, the first side of the first knob configured to attach to the threaded hole by a first threaded shaft, the second side of the knob having a second threaded section for connecting with a third threaded section of a base of the first accessory;

a second knob having a second threaded shaft to pass through an opening in a second accessory and mate with the threaded hole of the attachment, such that when the second accessory is positioned between the second knob and coupled with the attachment the second knob retains the second accessory on the attachment; and a first accessory and a second accessory for removably attaching to the attachment by the accessory connecting element.

13. The standing paddleboard paddling training apparatus kit of claim 12, wherein the attachment comprises:

a first body having a first paddle shaft shaped cutout;

a second body having a second shaft shaped cutout;

wherein the first body and second body are configured to join with each other such that first paddle shaped cutout and second paddle shaped cutout form a channel for receiving the paddle shaft when the attachment apparatus is in an assembled configuration; and, fasteners for coupling the first body to the second body.

14. The standing paddleboard paddling training apparatus kit of claim 12, wherein the first accessory comprises:

a training aid having a first base rotatably and removably attachable to the accessory connecting element and an elongated element pivotally attached to the base;

a lighting element having a second base configured for removably connecting with the attachment by the accessory connecting element; and, a net having a third base rotatably and removably attachable to the attachment by the accessory connecting element.

15. The standing paddleboard paddling training apparatus kit of claim 14, wherein the training aid is configured to move between a training configuration and a non-training configuration, wherein in the training configuration a terminal end of the elongated element is positioned relative to the base and attached to the paddle shaft such that the elongated element contacts a paddler at a maximum stroke point; and, wherein in the non-training configuration the terminal end of the elongated element is positioned relative to the base and attached to the paddle shaft such that the elongated element does not contact the paddler at the maximum stroke point.

16. The standing paddleboard paddling training apparatus kit of claim 12, wherein the second accessory comprises:

two opposing walled sections;

a curved surface spanning the walled sections;

the walled sections configured to straddle the attachment such that the curved surface abuts the first side of the attachment when the second accessory is coupled to the attachment;

wherein the second accessory comprises a weighted object for increasing an amount of force required to move the paddle when the second accessory is attached to the paddling apparatus.

* * * * *